US006729740B1

(12) United States Patent
Gazard

(10) Patent No.: US 6,729,740 B1
(45) Date of Patent: May 4, 2004

(54) DOOR KNOB NIGHT LIGHT

(76) Inventor: David Gazard, 4242 Henning Dr., Concord, CA (US) 94521

( * ) Notice: Subject to any disclaimer, the term of this patent is extended or adjusted under 35 U.S.C. 154(b) by 0 days.

(21) Appl. No.: 10/306,422

(22) Filed: Nov. 27, 2002

(51) Int. Cl.[7] ..... E05B 17/10

(52) U.S. Cl. ..... 362/100; 362/253; 362/311; 362/295; 362/802

(58) Field of Search ..... 362/100, 190, 362/191, 253, 802, 276, 295, 801, 311, 363

(56) References Cited

U.S. PATENT DOCUMENTS 3,955,075 A * 5/1976 Susedik ..... 362/100
4,777,570 A * 10/1988 Littles ..... 362/100
D322,550 S * 12/1991 Evans ..... D8/322
5,179,325 A * 1/1993 Aragon, Jr. ..... 315/136
5,398,175 A * 3/1995 Pea ..... 362/100
6,023,224 A * 2/2000 Meyvis ..... 315/153
6,132,057 A * 10/2000 Williams ..... 362/100
6,293,685 B1 * 9/2001 Polkow ..... 362/253
6,447,139 B1 * 9/2002 Wilkes ..... 362/100

* cited by examiner

*Primary Examiner*—Sandra O'Shea
*Assistant Examiner*—Ali Alavi

(57) ABSTRACT

The door knob night light is a modified door knob which includes a translucent or transparent door knob within which resides a lighting unit. The lighting unit would include a motion sensor, a light bulb and light bulb receptacle, a battery, and associated electrical circuitry and would be controlled by a three-way switch. The first switch position would allow the use of the door knob night light as a conventional night light with the bulb being continuously illuminated. The second position of the switch would deactivate the lighting assembly and would not permit any illumination of the light bulb. The third switch position would allow the light bulb to be illuminated whenever the motion sensor detects motion in the room where the door knob night light has been installed. Other than the switch, all of the components for the lighting assembly could be contained within the door knob.

20 Claims, 2 Drawing Sheets

DOOR KNOB NIGHT LIGHT

BACKGROUND OF THE INVENTION

1. Field of the Invention

The present invention relates to a nightlight for use in connection with a door knob. The door knob nightlight has particular utility in connection with providing an illuminated door knob to permit easier ingress to and egress from a room during the hours of darkness.

2. Description of the Prior Art

Night lights have long been useful for providing small amounts of illumination so individuals can safely traverse the inner areas of a house at night. Conventional nightlights are plugged into a wall socket and provide illumination to a restricted area around the wall plug. Since an individual moving around a house at night typically must pass through at least one door, a device which lights the doorknob for easy location would be beneficial in reducing stubbed toes and bruised shins experienced when an individual bumps into a door in the dark.

Many times home owners and small children are awakened during stormy weather at night. Power outages often accompany this type of weather, causing the house to be plunged into an impenetrable darkness. Typically, homeowners rely on candles, lanterns, or flashlights for illumination during power failures. One problem with these types of emergency illumination is that they are not easily located in the dark. Most homeowners keep matches and flashlights out of reach of children to prevent their use as toys; however, this makes these items hard to locate when the lights go out during a power failure. Additionally, candles can not safely be left burning after the occupants of a house are asleep, and flashlight batteries are quickly drained if the flashlight is activated for an extended amount of time. Therefore, a device that could safely and reliably provide illumination during an AC power outage would be beneficial to many homeowners.

While night lights are useful for providing small amounts of illumination during the dark hours, some individuals prefer to sleep in a room that is completely dark. Night lights can make it difficult for such individuals to fall asleep; however, these same individuals still benefit from the illumination provided by a night light should they awaken in the middle of the night. Additionally, operating battery powered night lights for the entire night can quickly drain the batteries and leave them useless in an emergency situation. Thus, a night light device that illuminates only upon detection of motion in the room would be beneficial to many homeowners.

The use of illuminated door knobs is known in the prior art. For example, U.S. Pat. No. 4,777,570 to Glen Littles discloses an illuminated doorknob lock that consists of a translucent knob that receives the elongated stem of a doorknob lock set and contains one or more incandescent bulbs. The energy source would be provided by either a battery pack or the electrical wiring of the building provided for the doorbell circuit. However, the Littles '570 device requires the modification of the door through the addition of a battery pack and wiring for a DC power source or the addition of wiring from an AC power source in the house. Additionally, the Littles '570 device makes no provision for illuminating the light source upon detection of motion and requires either that the light source be continuously illuminated or that the individual press a button to provide illumination as he attempts to unlock the door. Continuous illumination of the light source can cause rapid drainage of a DC power source and can waste electricity from an AC source, while requiring the individual to press a button for illumination requires the user to find the door knob in the dark and does not guarantee that the light will be illuminated long enough for the user to find the proper key and successfully insert it into the lock.

U.S. Pat. No. 6,132,057 to Christine Janet Williams discloses a night light for illuminating door knobs that comprises a horseshoe shaped acrylic prism that fits over a standard sized door knob and then resides upon the back plate of the door knob. The prism is lit by two LED devices and is powered by small batteries. However, the Williams '057 patent does not provide a means for providing illumination when motion is detected. Instead, the Williams '057 device is activated by a manual switch, requiring the user to turn the device on at night and off in the morning. Should the user forget to turn the switch on at night, he would be faced with a darkened room when he awakes in the middle of the night, and should he forget to turn the device off in the morning, he might be faced with run down batteries. Moreover, if the user is disturbed by illumination when he is trying to sleep, the manual operation of the Williams '057 device would render it unsuitable for his needs. Similarly, U.S. Pat. No. Des. 322,550 to Deborah Evans discloses the ornamental design for a combination door knob cover and night light that consists of a switch that illuminates an EXIT banner located on the door knob. However, the Evans '550 patent does not indicate the type of power or light source to be used with the door knob. An AC power source would require modification to the door, while a higher wattage light source could lead to heating of the door knob and possible bums to an individual grasping the door knob. Additionally, the switch provided by the Evans '550 patent requires manual intervention of an individual to illuminate or extinguish the light source in the door knob cover. Should an individual fail to illuminate the light prior to darkness, he would be forced to stumble in the dark until the door knob and switch were located. Furthermore, failure to extinguish the light source by manually moving the switch to the OFF position would result in the drainage of a DC battery source.

U.S. Pat. No. 5,398,175 to Todd D. Pea discloses an illuminated door knob lock that consists of a door knob, a door locking set with a DC light source placed adjacent to the keyhole, and a removable DC power source. However, the Pea '175 patent does not provide a mechanism for illuminating the light source when motion is detected; instead this device requires the user to push on the door knob to activate the light. Thus, an individual is forced to stumble in the dark until the door and the door knob are located. Furthermore, while the Pea '175 device uses a door knob under spring pressure to automatically turn the light source off, there is no guarantee that an individual can find the proper key, insert it into the locking mechanism, and unlock the door before the light source is extinguished.

Likewise, U.S. Pat. No. 6,023,224 to Daniel Vincent Meyvis discloses a door frame with integrated keyless entry system that includes a pre-assembled door and door frame unit having an electric light, a motion detector, a radiant energy receiver, and an electromechanically actuated latch all disposed on and built into the door frame. However, the Meyvis '224 patent requires the purchase of a specialized door and door frame, which could be cost prohibitive for most homeowners. Additionally, the Meyvis '224 device is not portable to other rooms, requiring permanent installation in one door frame.

Lastly, U.S. Pat. No. 3,955,075 to Joseph Susedik discloses a doorknob illuminating device that utilizes a Lucite rod illuminated by a light source. The Lucite rod, in turn, illuminates a Lucite rose ring which illuminates the area around the keyhole. However, the Susedik '075 patent requires either the purchase of a new door containing a light source or the permanent modification of an existing door or door frame with the addition of a light source near the doorknob area. Additionally, the Susedik '075 patent does not provide a means for detecting motion and illuminating the doorknob as a result; thus the Susedik '075 device would remain illuminated until manually turned off, leading to wasted energy and possible interference with an individual's sleep patterns. Finally, the Susedik '075 device is not portable to other doors, requiring permanent installation into the door and door frame.

While the above-described devices fulfill their respective, particular objectives and requirements, the aforementioned patents do not describe a door knob night light that provides a small area of illumination around a door knob from a DC power source and that can be continuously activated as is a standard night light or that can be activated with a motion detector. The Littles '570, Susedik '075, and Meyvis '224 devices are not portable, requiring permanent installation in and/or modification to the door and door frame. Moreover, the Meyvis '224 and Susedik '075 patent require the purchase of specialized doors and/or door frames, which could be cost prohibitive for most homeowners. Furthermore, the Littles '570, Williams '057, Pea '175, and Susedik '075 patents make no provision for illuminating the light source upon detection of motion, resulting in a variety of problems. The Littles '570 device requires either that the light source be continuously illuminated or that the individual press a button to provide illumination as he attempts to unlock the door, while the Pea '175 and Susedik '075 device require the user to push on the door knob to activate the light. Continuous illumination of the light source can cause rapid drainage of a DC power source and can waste electricity from an AC source. Requiring the individual to press a button or the door knob for illumination forces the user to stumble in the dark until the door and the door knob are located and does not guarantee that the light will remain illuminated long enough for the proper key to be found and inserted into the lock. Both the Williams '057 and Evans '550 devices are activated by a manual switch, requiring the user to turn the device on at night and off in the morning. Should the user forget to turn the switch on at night, he would be faced with a darkened room when he awakes in the middle of the night, and should he forget to turn the device off in the morning, he might be faced with run down batteries. Moreover, if the user is disturbed by illumination when he is trying to sleep, the manual operation of the Williams '057 and Evans '550 devices would render them unsuitable for his needs. Finally, the Evans '550 patent does not indicate the type of power or light source to be used with the door knob. An AC power source would require modification to the door, while a higher wattage light source could lead to heating of the door knob and possible burns to an individual grasping the door knob.

Therefore, a need exists for a new and improved door knob night light that can be used for providing an illuminated door knob to permit easier ingress to and egress from a room during the hours of darkness. In this regard, the present invention substantially fulfills this need. In this respect, the door knob night light according to the present invention substantially departs from the conventional concepts and designs of the prior art, and in doing so provides an apparatus primarily developed for the purpose of safely and reliably providing a small amount of illumination which lights the doorknob for easy location, does not rely on AC power, and can be turned OFF, continuously illuminated, or illuminated only upon detection of motion in the room.

SUMMARY OF THE INVENTION

In view of the foregoing disadvantages inherent in the known types of illuminated door knobs now present in the prior art, the present invention provides an improved door knob night light, and overcomes the above-mentioned disadvantages and drawbacks of the prior art. As such, the general purpose of the present invention, which will be described subsequently in greater detail, is to provide a new and improved door knob night light and method which has all the advantages of the prior art mentioned heretofore and many novel features that result in a door knob night light which is not anticipated, rendered obvious, suggested, or even implied by the prior art, either alone or in any combination thereof.

To attain this, the present invention essentially comprises a door knob shaped translucent housing containing a motion sensor, a light bulb, a three-way switch, a battery, and associated electrical wiring.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved door knob night light that has all of the advantages of the prior art illuminated door knobs and none of the disadvantages.

It is another object of the present invention to provide a new and improved door knob night light that may be easily and efficiently manufactured and marketed.

An even further object of the present invention is to provide a new and improved door knob night light that has a low cost of manufacture with regard to both materials and labor, and which accordingly is then susceptible of low prices of sale to the consuming public, thereby making such a door knob night light economically available to the buying public.

Still another object of the present invention is to provide a new door knob night light that provides in the apparatuses and methods of the prior art some of the advantages thereof, while simultaneously overcoming some of the disadvantages normally associated therewith.

Even still another object of the present invention is to provide a door knob night light for providing a small amount of illumination in the door knob area of a room. This allows easier egress from and ingress into a room during darkness hours and aids an individual in avoiding bruised shins, stubbed toes, and other injuries sustained from stumbling into a door in the dark.

Yet another object of the present invention is to provide a door knob night light that utilizes a DC power source. This ensures that illumination of the door area of a room will be available to the user even during an AC power outage and in dwellings where AC power does not exist.

Even yet another object of the present invention is to provide a door knob night light that can be configured to provide illumination only when motion is detected within the room in which the door knob night light has been installed. This provides an individual with a small amount of illumination to light his path should he awaken in the middle of the night but does not provide continuous illumination that could interfere with his sleeping.

Lastly, it is an object of the present invention to provide a new and improved door knob night light that can be configured as a conventional night light or as an emergency light that illuminates only when motion is detected and can also be turned off completely. This allows multiple applications for the door knob night light, making it a useful and adaptable purchase.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
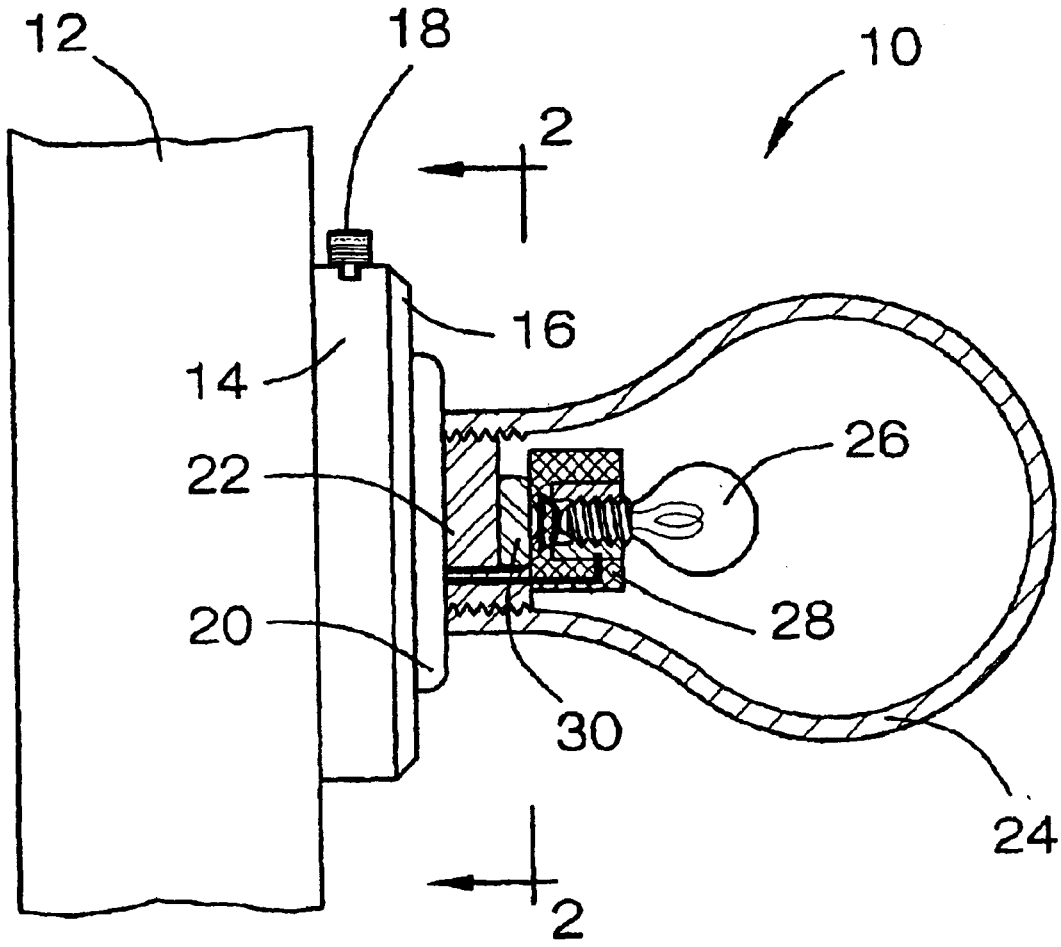
FIG. 1 is a left side view of the preferred embodiment of the door knob night light constructed in accordance with the principles of the present invention.
Figure 3:
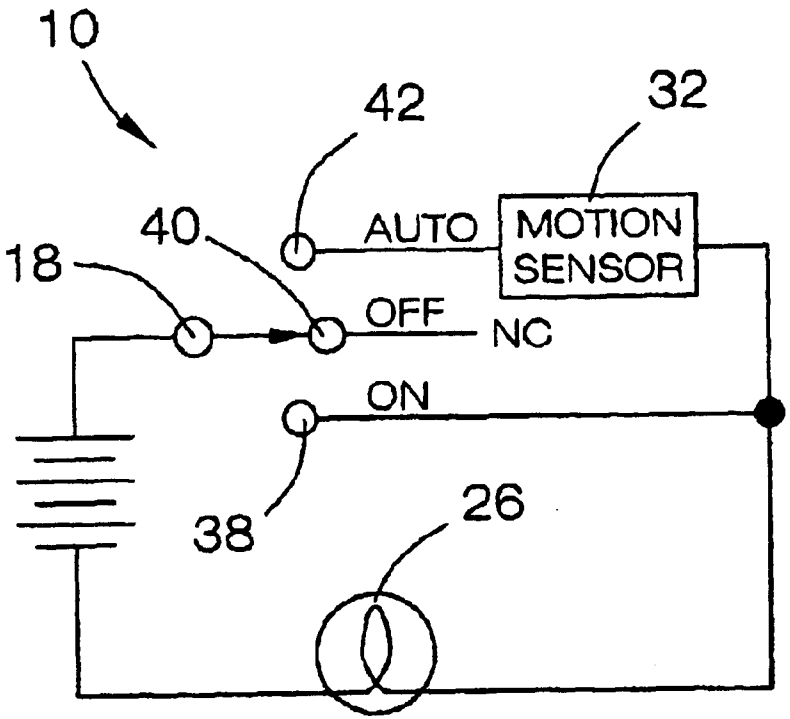
FIG. 3 is a functional diagram of the door knob night light of the present invention.
Figure 2:
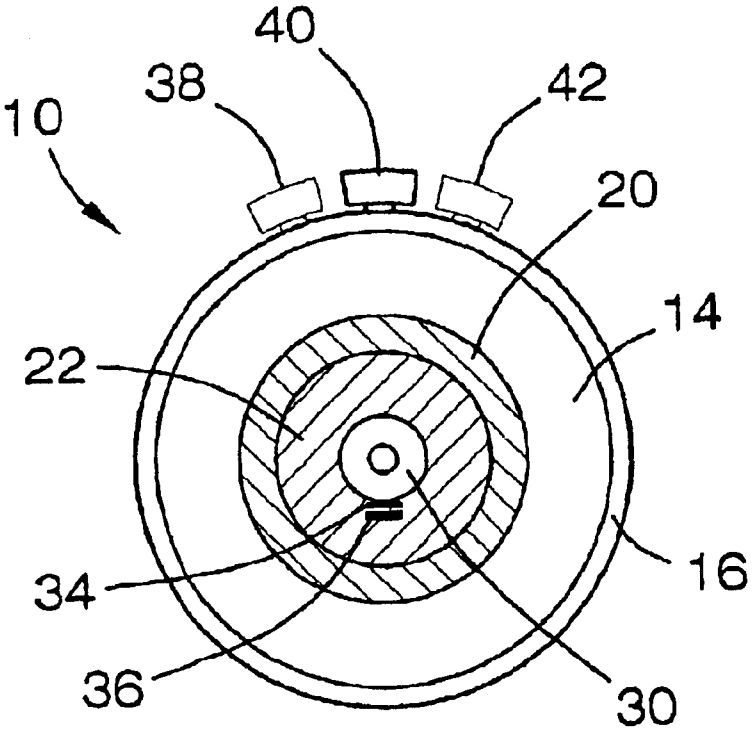
FIG. 2 is a front sectional view of the door knob night light of the present invention.

Referring now to the drawings, and particularly to FIGS. 1–3, a preferred embodiment of the door knob night light of the present invention is shown and generally designated by the reference numeral 10.

In FIG. 1, a new and improved door knob night light 10 of the present invention for providing an illuminated door knob to permit easier ingress to and egress from a room during the hours of darkness is illustrated and will be described. More particularly, the door knob night light 10 is mounted on a door 12 by affixing the circular base 14 to the door 12. The base 12 has a beveled outer edge 16 and features a three-way switch 18 for activation and deactivation of the door knob night light 10. Mounted on the base 14 is a circular door knob support 20 having a circular threaded shaft extending from the center onto which the threaded edge 22 of the doorknob 24 is screwed. The doorknob 24 would be made of a sturdy material that is at least translucent, but could also be transparent, and has a rounded form similar to conventional doorknobs of this shape. Within the doorknob 24 a light bulb 26 mounted in a light bulb receptacle 28 and powered by a removable battery 30. A motion sensor 32 and associated wiring would also be incorporated into the doorknob for use in controlling the illumination of the light bulb 26. A spring metal connector 34 would be connected to the light bulb receptacle 28, and a strip metal connector 36 would be connected to the battery 30.

FIG. 2 is a front cross sectional view of the door knob night light 10. The three positions for the three-way switch 18 are ON 38, in which the light bulb 26 is continuously illuminated, OFF 40, in which the light bulb 26 is never illuminated, and AUTO 42, in which the light bulb 26 is illuminated when the motion sensor 32 detects motion within the room in which the door knob night light 10 is placed. The circular nature of the base 14 and door knob support 20 are detailed in this view, as well as the strip metal 36 connection to the battery 30 and the relevant location of the spring metal connector 34.

FIG. 3 is a functional diagram of the door knob night light 10. In this view, the three-way switch 18 is placed in the OFF 40 position. This breaks the electrical connection to the light bulb 26 so that it is not illuminated. If the switch 18 were placed in the ON 38 position, the electrical circuit would be completed, and the light bulb 26 would be continuously illuminated. If the switch 18 were placed in the AUTO 42 position, the motion sensor 32 would complete the circuit when motion was detected, illuminating the light bulb 26 at the time of detection.

In use, it can now be understood that the homeowner would replace a conventional door knob assembly for an interior door or the interior surface of an exterior door with the door knob night light 10. The individual would then set the three-way switch 18 to the desired position. If no illumination of the light bulb 26 is desired, then the switch 18 can be placed in the OFF 40 position. If the individual wishes to use the device as a conventional night light, then the switch 18 can be placed in the ON 38 position for continuous illumination of the light bulb 26. If the individual wishes to have illumination only upon awakening in the middle of the night, then the switch 18 can be placed in the AUTO 42 position for illumination upon detection of motion within the room in which the door knob night light 10 has been installed. Should the battery 30 or light bulb 26 need to be replaced, the owner would simply unscrew the doorknob 24, replace the battery 30 and/or the light bulb 26, and replace the doorknob 24 by screwing it tight to the door knob support 20.

While a preferred embodiment of the door knob night light has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material that ranges in light admittance from translucent to transparent, such as Lucite, plastic, or glass, may be used for the doorknob. And although providing an illuminated door knob to permit easier ingress to and egress from a room during the hours of darkness has been described, it should be appreciated that the door knob night light herein described is also suitable for use as an emergency light source while traveling, camping, or in other situations where a small amount of light might prove useful. Furthermore, a wide variety of colored light bulbs or door knobs could be used to enhance the beauty of the device.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A door knob night light comprising:

a flat door knob base having a front surface and a rear surface;

a circular door knob support having a rear surface and a front surface having an outer edge and a center with a threaded door knob support shaft extending perpendicularly from said center and connected on said rear surface to said front surface of said door knob base;

a hollow, translucent door knob having a globular main portion, with an interior and an exterior, extending from an internally threaded cylindrical base portion and removably connected on said cylindrical base portion to said door knob support shaft;

a battery unit removably connected to said door knob support shaft;

a light bulb receptacle having a front formed with a threaded transverse aperture and a rear and connected on said rear to said battery unit;

a light bulb having a threaded base and removably connected on said base to said light bulb receptacle wherein said light bulb is screwed into said threaded transverse aperture of said light bulb receptacle;

an electrical control circuit connected to said battery unit and to said light bulb recptacle;

a motion sensor connected to said electrical control circuit; and a three-way switch having a first, second, and third position and connected to said base and to said electrical control circuit.

2. The door knob night light of claim 1 wherein said door knob base is circular with a beveled outer edge and has a diameter greater than that of said doorknob support.

3. The door knob night light of claim 1 wherein said three-way switch is located on said door knob base.

4. The door knob night light of claim 1 wherein said three-way switch has a first ON position in which said battery unit is connected to said light bulb receptacle through said electrical control circuit wherein said light bulb is continuously illuminated.

5. The door knob night light of claim 4 wherein said three-way switch has a second OFF position in which no connection is made by said electrical control circuit between said battery unit and said light bulb receptacle resulting in no illumination of said light bulb.

6. The door knob night light of claim 5 wherein said motion sensor is capable of detecting motion within the room in which said door knob night light is placed and is also capable of generating a signal when said motion is detected.

7. The door knob night light of claim 6 wherein said three-way switch has a third AUTO position in which said battery unit is connected to said light bulb receptacle when said signal from said motion sensor occurs wherein said light bulb is illuminated when said motion is detected by said motion sensor.

8. The door knob night light of claim 1 wherein said door knob is made of a sturdy material that has the property of admitting light in the range from translucency to transparency wherein said material can be manufactured in a variety of colors.

9. The door knob night light of claim 1 wherein said light bulb is able to be illuminated from a DC power source and can be manufactured in a variety of colors.

10. The door knob night light of claim 1 wherein said electrical control circuit contains spring metal connecting said battery unit to said electrical control circuit and strip metal connecting said light bulb receptacle to said electrical control circuit.

11. The door knob night light of claim 1 wherein said door knob night light can replace a conventional door knob assembly and is able to control the door latch pin when rotated.

12. The door knob night light of claim 1 wherein said motion sensor is connected to said door knob support.

13. The door knob night light of claim 1 wherein said motion sensor is connected to said door knob base.

14. The door knob night light of claim 1 wherein said motion sensor is connected to said door knob.

15. A door knob night light comprising:

a circular door knob base having a front surface and a rear surface;

a circular door knob support having a diameter less than that of said door knob base, a rear surface, and a front surface having an outer edge and a center with a threaded door knob support shaft extending perpendicularly from said center and connected on said rear surface to said front surface of said door knob base;

a hollow, translucent door knob having a globular main portion, with an interior and an exterior, extending from an internally threaded cylindrical base portion and removably connected on said cylindrical base portion to said door knob support shaft;

a battery unit removably connected to said door knob support shaft and residing within said interior of said door knob;

a light bulb receptacle having a front formed with a threaded transverse aperture and a rear and connected on said rear to said battery unit and residing within said interior of said door knob;

a light bulb having a threaded base and removably connected on said base to said light bulb receptacle wherein said light bulb is screwed into said threaded transverse aperture of said light bulb receptacle;

an electrical control circuit connected by spring metal to said battery unit and by strip metal to said light bulb receptacle;

an automatic activator connected to said electrical control circuit; and a three-way switch having a first, second, and third position and connected to said base and to said electrical control circuit.

16. The door knob night light of claim 15 wherein said automatic activator is a motion sensor capable of detecting motion within the room in which said door knob night light is placed and of generating a signal when said motion is detected.

17. The door knob night light of claim 16 wherein said three-way switch has a first ON position in which said battery unit is connected to said light bulb receptacle through said electrical control circuit wherein said light bulb is continuously illuminated, a second OFF position in which no connection is made by said electrical control circuit between said battery unit and said light bulb receptacle resulting in no illumination of said light bulb, and a third AUTO position in which said battery unit is connected to said light bulb receptacle when said signal from said motion sensor occurs wherein said light bulb is illuminated when said motion is detected by said motion sensor.

18. The door knob night light of claim 15 wherein said door knob is made of a sturdy material that has the property of admitting light in the range from translucency to transparency wherein said material can be manufactured in a variety of colors.

19. The door knob night light of claim 15 wherein said light bulb is able to be illuminated from a DC power source and can be manufactured in a variety of colors.

20. The door knob night light of claim 15 wherein said door knob night light can replace a conventional door knob assembly and is able to control the door latch pin when rotated.

* * * * *